US009595796B2

(12) United States Patent
Yen et al.

(10) Patent No.: US 9,595,796 B2
(45) Date of Patent: Mar. 14, 2017

(54) ELECTRICAL CONNECTOR

(71) Applicant: Chant Sincere Co., Ltd., New Taipei (TW)

(72) Inventors: Ming Hui Yen, New Taipei (TW); Chun-Hsiang Hsu, New Taipei (TW)

(73) Assignee: CHANT SINCERE CO., LTD. (TW)

( * ) Notice: Subject to any disclaimer, the term of this patent is extended or adjusted under 35 U.S.C. 154(b) by 0 days.

(21) Appl. No.: 14/714,686

(22) Filed: May 18, 2015

(65) Prior Publication Data

US 2015/0340821 A1 Nov. 26, 2015

(30) Foreign Application Priority Data

May 23, 2014 (TW) ..... 103209064 U
Jul. 31, 2014 (TW) ..... 103213572 U

(51) Int. Cl.

| | |
|---|---|
| ***H01R 13/648*** | (2006.01) |
| ***H01R 24/62*** | (2011.01) |
| ***H01R 13/46*** | (2006.01) |
| ***H01R 13/6581*** | (2011.01) |
| *H01R 107/00* | (2006.01) |
| *H01R 13/506* | (2006.01) |
| *H01R 13/6585* | (2011.01) |

(52) U.S. Cl.
CPC ..... *H01R 24/62* (2013.01); *H01R 13/46* (2013.01); *H01R 13/6581* (2013.01); *H01R 13/506* (2013.01); *H01R 13/6585* (2013.01); *H01R 2107/00* (2013.01)

(58) Field of Classification Search
CPC ..... H01R 23/6873; H01R 13/65802; H01R 13/658; H01R 13/6582; H01R 13/506111
See application file for complete search history.

(56) References Cited

U.S. PATENT DOCUMENTS

| | | | | |
|---|---|---|---|---|
| 6,976,876 | B1 * | 12/2005 | Su | H01R 13/6583 439/357 |
| 7,628,638 | B2 * | 12/2009 | Wu | H01R 9/032 439/353 |
| 7,758,379 | B2 * | 7/2010 | Chen | H01R 13/6485 439/607.11 |
| 8,684,769 | B2 * | 4/2014 | Kao | H01R 13/6471 439/607.28 |
| 8,968,031 | B2 * | 3/2015 | Simmel | H01R 13/659 439/108 |
| 2015/0364871 | A1 * | 12/2015 | Lin | H01R 13/6581 439/607.58 |

* cited by examiner

*Primary Examiner* — Xuong Chung Trans
(74) *Attorney, Agent, or Firm* — Bacon & Thomas, PLLC

(57) ABSTRACT

An electrical connector comprises a terminal set configuring the terminals parallelly, an insulative base preserving said terminal set with a plurality of terminal grooves as an external conductive sheet slot is disposed between certain terminal grooves, defining an inner side of the hollow center in the mating direction, a pair of resilient arms disposed within the trough ways configured on the both sides of said insulative base and a shielding assembly having a metal casing accommodating said insulative base, defining an external opening, an external conductive sheet received by said external conductive sheet slot.

12 Claims, 12 Drawing Sheets

ELECTRICAL CONNECTOR

CROSS-REFERENCE TO RELATED APPLICATIONS

This application claims the benefit of the filing date under 35 U.S.C. §119(a)-(d) of Taiwan Patent Applications No. 103209064, filed May 23, 2014, and No. 103213572, filed Jul. 31, 2014.

BACKGROUND OF THE INVENTION

Field of the Invention

The present invention is related to an electrical connector, and more particularly to an electrical connector having modified mating way.

Description of the Related Art

Taiwan Patent No. I420749 discloses a conventional USB connector. The conventional electrical connector comprises a metal case, an insulative base having a slot, an open area near the slot and fixed to the slot of the insulative base, a plurality of contacts provided below the open area with the middle portion connected between the front and rear ends, wherein a first signal differential pair, a second signal differential pair and a third signal differential pair is provided, and the first signal differential pair and the third signal differential pair are set forth for USB3.0, and the second signal differential pair set forth for USB2.0. A contact arrangement is configuring and having a power contacts and ground contacts apart from one another; each of the contacts of the contact arrangement are enveloped with the insulative base. The first signal differential pair includes a first signal contact and a second signal contact; the second signal contact is closer than the first signal contact to the second signal differential pair. The third signal differential pair includes a third signal contact and a fourth signal contact; the third signal contact is closer than the fourth signal contact to the second of the signal differential pair. The first signal differential pair and a third signal differential pair is provided on sides of the second of the signal differential pair. At least one power contact or ground contact has spaced the rear end portion of the first signal differential pair and the rear end portion of the third signal differential pair with the rear end portion of the second signal differential pair. The center of USB2.0 signal differential pair is provided with one ground contact of USB3.0. The front end portion of the second signal contact includes a bent portion above the open area; the end of said bend portion is closer than the middle portion of the second signal contact to the second signal differential pair. The front end portion of the third signal contact includes a bent portion above the open area; the end of said bend portion is closer than the middle portion of the third signal contact to the second signal differential pair.

A conventional universal serial bus (USB) is for solving the crosstalk problem and the related problems arising from upgrading the transmission interface, in which the bus is made backwards compatible with bus of earlier versions, and the transmission speed and transmission frequency of the bus contacts are increased, and in which the USB connectors are made to reach a high-speed and high-frequency transmission. However, up until now, there have been more innovative transmission interfaces invented. The conventional solutions are insufficient to cope with the new technology issues.

SUMMARY OF THE INVENTION

The electrical connector of the present invention comprises a terminal set, an insulative base, a pair of resilient arms, a shielding assembly and an external conductive sheet. The terminals in the terminal set are disposed on an upper row and a lower row. The insulative base securely fixes the terminal set within a plurality of terminal grooves, between which an external conductive sheet slot is disposed. The surrounding of a hollow mating portion is an inner side. The pair of resilient arms is configured in the trough ways on the both sides of the insulative base. The shielding assembly includes a metal casing which contains the insulative base, an external opening which is in the mating direction, at least one resistant arm disposed near the external opening, and a resistant contact disposed towards the inner side. The external conductive sheet is disposed in the external conductive sheet slot, and a pair of resilient conductive tails is disposed on both sides of the external conductive sheet.

In one embodiment of the present invention, the terminal set is provided with rows defined by an upper and a lower flat. Each terminal includes a contact portion and a connecting portion; said contact portion and said connecting portion respectively are configured from a terminal body and extended to both ends of said terminal, wherein an oblique is disposed on said contact portion.

In one embodiment of the present invention, a resilient portion which is declined from said terminal body to the center reference point is configured between said terminal body and said contact portion of said terminal in said terminal set; said a plurality of terminal grooves is provided for retaining the terminals and having a sunken in the vertical direction; an inclining is disposed on said terminal groove corresponding to said oblique of said contact portion.

In one embodiment of the present invention, the conductive tails of the external conductive sheet includes a first intruding end and a second intruding end which is extended from a ring body with bendings.

In one embodiment of the present invention, the said first intruding end is contacted with said resilient arm; said second intruding end is contacted with said metal casing.

In one embodiment of the present invention, the internal conductive sheet slots are disposed on the top surface and the bottom surface of said insulative base; said shielding assembly further includes a pair of internal conductive sheets whom said internal conductive sheet slot hold, where said resistant arm is located.

In one embodiment of the present invention, the internal conductive sheet slot is provided with a ridge-like second holder adjacent to an internal opening of said insulative base and a planar first holder away from said internal opening, a step standing between said internal conductive sheet slot and said second holder.

In one embodiment of the present invention, at least one recession is disposed on the internal conductive sheets, each recession forming said resistant arm along with one of its edge, and said resistant arm is provided with a bending portion extending said resistant contact.

In one embodiment of the present invention, the end of said resistant contact is provided with a poke corresponding to a cavity poke disposed on said internal conductive sheet.

In one embodiment of the present invention, the electrical connector is predetermined with a front end plane in the mating direction, a back end plane opposite to said front end plane, and a center body portion which is between said front end plane and said back end plane; said external conductive sheet and a pair of internal conductive sheets are given with a approximate front-rear placement, wherein said pair of internal conductive sheets adjacent to said front end plane; said external conductive sheet adjacent to said back end plane is located in the middle of said pair of internal conductive sheets, sandwiched between said terminal set.

In one embodiment of the present invention, the insulative base comprising a main body, a first subordinate base and a second subordinate base, said first subordinate base preserves a first connecting portion of a first terminal set of said terminal set; said second subordinate base preserves a second connecting portion of a second terminal set of the said terminal set, wherein said first subordinate base is disposed on one side of said second subordinate base, said contact portion of said terminal set movably receiving in a part of said insulative base.

In one embodiment of the present invention, the insulative base is provided with a plurality of engaging notches as a first engaging portion of said first subordinate base and a second engaging portion of said second subordinate base are respectively engaged to said engaging notches.

The characteristics and advantages of the present invention will be readily appreciated with reference to the following embodiments along with the appended drawings.

DETAILED DESCRIPTION OF THE EMBODIMENT(S)

Figure 1:
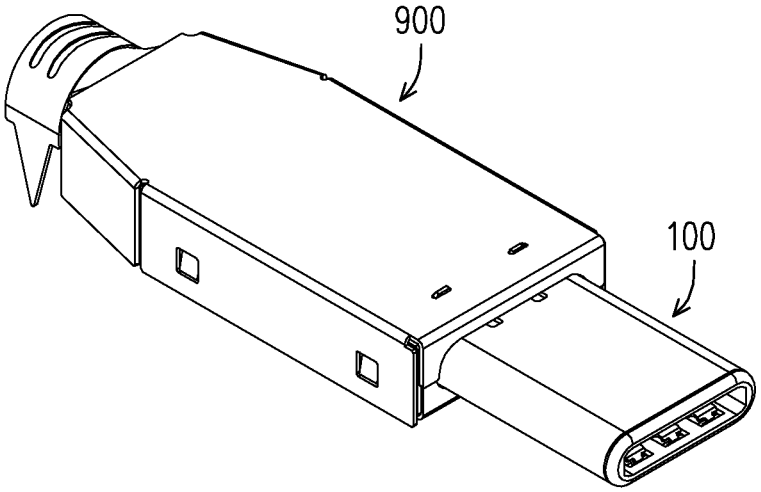
FIG. 1 is a trial fit view of an electrical connector and a cable assembly of the present invention.
Figure 2:
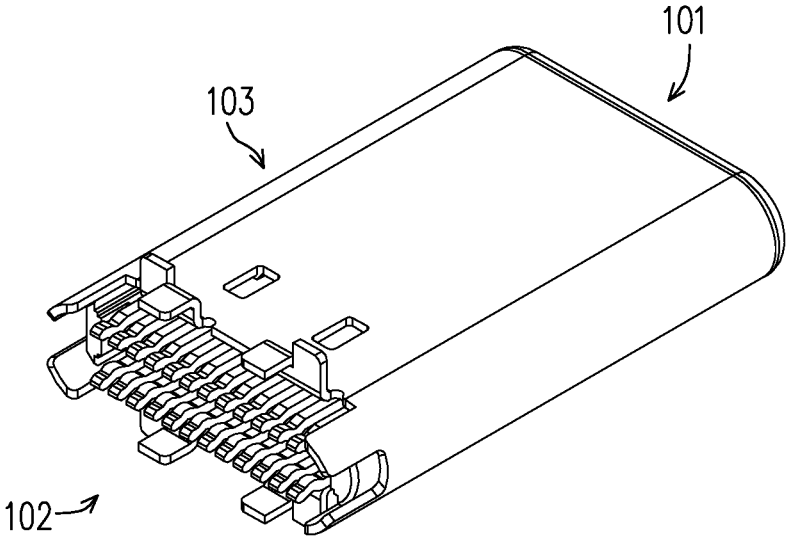
FIG. 2 is a perspective view of an electrical connector of the present invention.

To realize an electrical connector with enhanced efficiency, the following description is the concrete implementation of the present invention. First of all, FIG. 1, a trial fit view of the electrical connector 100 and a cable assembly 900, illustrates the electrical connector of the present invention when being applied. The electrical connector 100 is further depicted in FIG. 2, wherein a front end plane 101, a back end plane 102 and a center body portion 103 are defined by the way the electrical connector 100 being used. The front end face 101 is close to the counter-connected face. The back end plane 102 is on the other side of the front end plane 101. The center body portion 103 is in between the above two planes.

Before more specifically describing the preferred embodiments, the composition of all the parts of the present invention is explained as follows. Please refer to FIG. 3 and FIG. 4, in which the electrical connector 100 comprises a terminal set 200 which conducts the electrical signal and a non-conductive insulative base 300 which securely fixes the terminal set 200. The periphery of a hollow part of the insulative base 300 in the connecting direction is an inner side 318. The electrical connector further comprises a shielding assembly 400, which extensively includes a metal casing 401, an external conductive sheet 501 and a pair of internal conductive sheet 502, 503. The metal casing 401 contains the insulative base 300, an external opening 402 which is in the connecting direction, at least one resistant arm 512 disposed near the external opening, and a resistant contact 514 disposed towards the inner side 318.

When manufacturing the electrical connector 100, the insulative base 300 securely fixes the terminal set 200 by way of assembly or ejecting the non-conductive material to envelope the terminal set 200 and thus the terminal set 200 is immovably held by the insulative base 300. Both methods utilize the interference between the insulative base 300 and the terminal set 200 to make the terminal set 200 held by the insulative base 300. Secure a pair of resilient arms 801, 802, the external conductive sheet 501 into the insulative base 300 orderly, and install the internal conductive sheets 502, 503 on the top and the bottom of the insulative base 300, and then install a rear base 301 in the tail portion of the insulative base 300. Finally, the insulative base 300 which is loaded with all the components is inserted into the metal casing 401 from the external opening 402.

Figure 7:
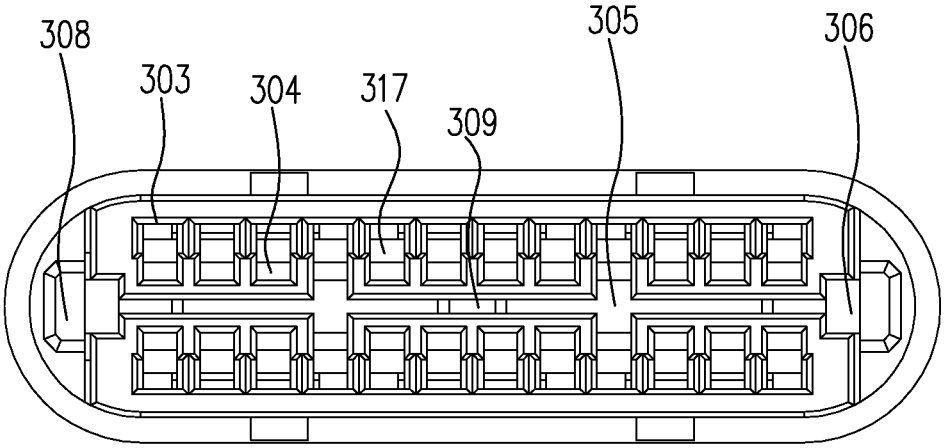
FIG. 7 is a rear view of FIG. 5.
Figure 8:
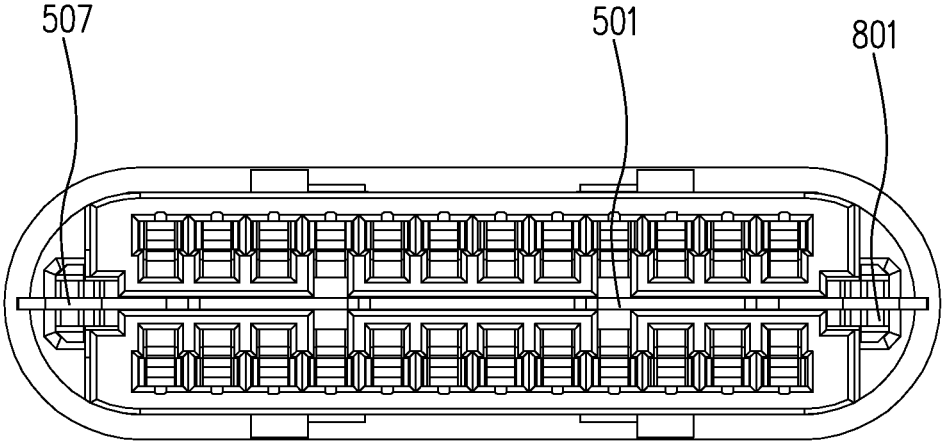
FIG. 8 is a rear view of FIG. 6.
Figure 14:
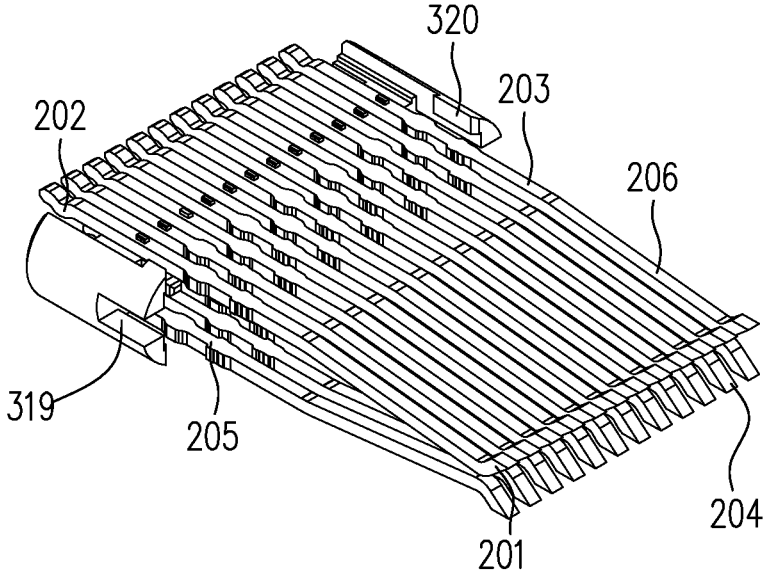
FIG. 14 is a perspective view of a rear base and the terminal set of an electrical connector of the present invention.

FIG. 7 and FIG. 14 describe more specifically the relationship between the terminals and the insulative base. The terminals in the terminal set 200 are disposed in the upper row and the lower row. Each terminal includes a contact portion 201, a connecting portion 202 and the terminal body 203. The terminal body 203 is the foundation portion of the terminals and extends towards both side of the terminal to constitute the contact portion 201 and the connecting portion 202 respectively. The contact portion 201 configuring with certain oblique 204 contacts with the terminals of the counter connector (not shown in the drawings) and conducts electrical signals. A resistant portion 205 is disposed on the terminal body 203 and interferes with the inside of the insulative base 300 to increase retention strength. The resilient portion 206 which obliquely extends from the terminal body 203 to the center base level is disposed between the terminal body 203 and the contact portion 201. It enables the contact portion 201 of the upper row terminal to become nearer to the lower row terminal (relative to the terminal body 203 of the upper row and lower row terminals). The connecting portion 202 is disposed for connecting to the circuit board or to a cable; it is expected to have the board clamping approach or the welding approach in the prior art. The first terminal groove 303 in FIG. 7 is provided to contain the terminal. As terminals made via assembly, there is a sunken 304 in the first terminal slot 303 which enables the resilient portion 206 inclined and the contact portion 201 formed with the oblique 204 to be inserted into the sunken 304. A second terminal groove 305 can be disposed between the first terminal groove 303 for the upper row terminal and the lower row terminal to use jointly. Please refer to the perspective view in FIG. 5.

FIGS. 5, 6, 7 and 8 describe the relationship between the resilient arms 801, 802 and the insulative base in detail. The resilient arms are disposed in a left row and a right row. Each resilient arm includes a pressing portion 803 and bulges 804. The resilient arm 801 penetrates the trough way 306 of the insulative base 300, going through an unopened portion until a resilient arm break 307. The pressing portion 803 is located inside the opened resilient arm break 307, and a position near an internal opening 302 of an excavated area is a first wall 308. The bulge 804 is wedged between the trough way 306 and a second wall 322 of the insulative base 300.

Figure 12:
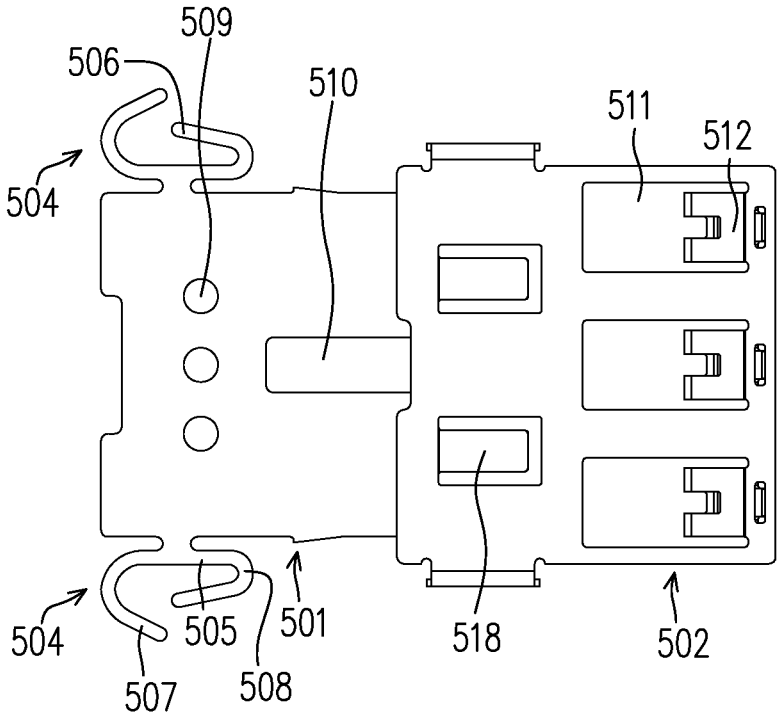
FIG. 12 is a top view of FIG. 9.
Figure 15:
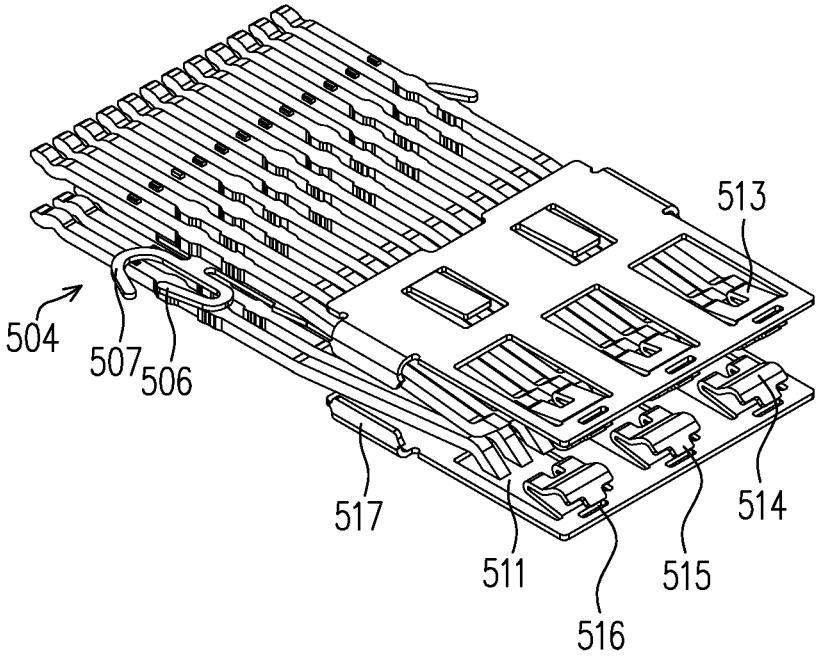
FIG. 15 is a perspective view of FIG. 11.
Figure 16:
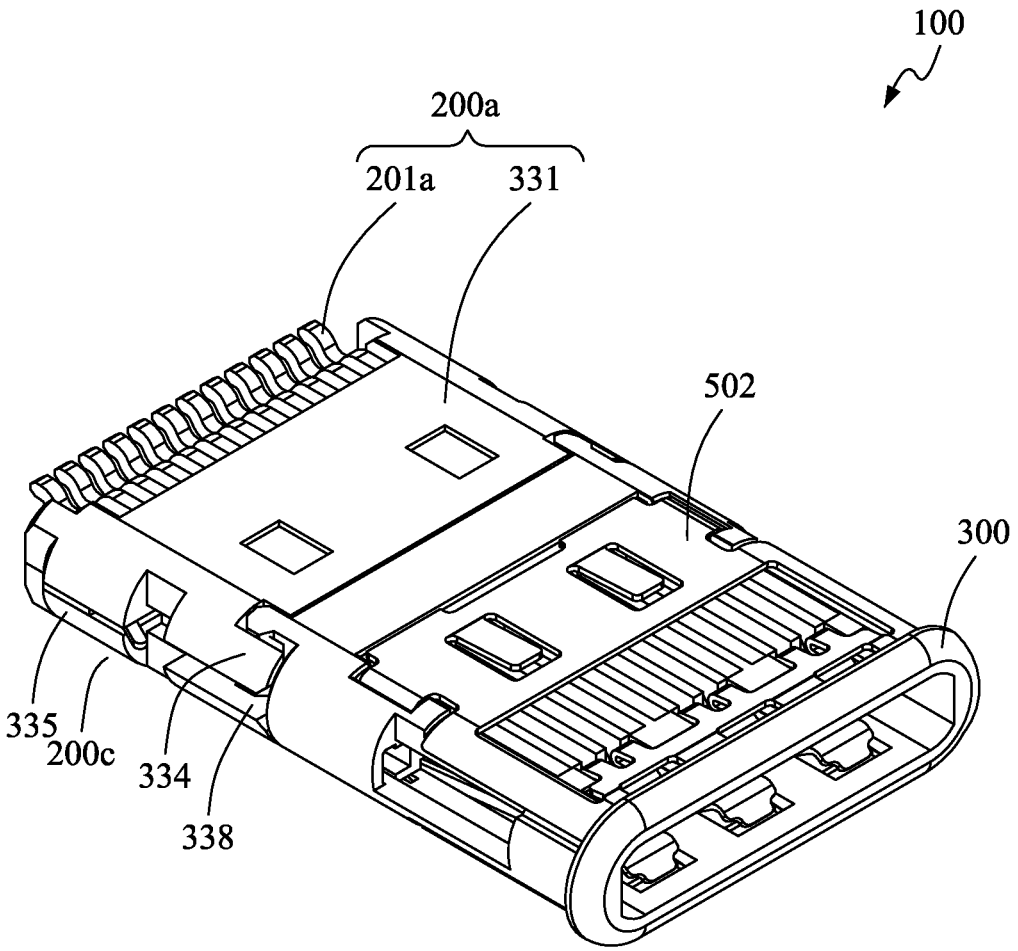
FIG. 16 is a perspective view of an electrical connector according to another embodiment of the present invention.

FIG. 12 and FIG. 15 show the external conductive sheet 501 and a pair of internal conductive sheets 502, 503 of the shielding assembly 400. The external conductive sheet 501 is disposed in a side the electrical connector 100. However, when connecting with the counter connector (not shown in the drawings), the external conductive sheet 501 achieve the shielding effect at the relatively front part of the counter connector, and the internal conductive sheets 502, 503 achieve the shielding effect at the relatively rear part of the counter connector (inner side of the tongue portion). The resilient conductive tail 504 (disposed for a better structure, and are not limited to circular formation) are disposed on both sides of the external conductive sheet 501, and include the ring body 505, the first intruding end 506 and the second intruding end 507. The first intruding end 506 and the second intruding end 507 are extended from the ring body 505, and the extending portion can be designed as a bending 508. The main body of the external conductive sheet 501 is provided with apertures 509 for the positioning of a mold and an empty portion 510 for interfering with the insulative base 300.

The resistant arm 512 can be formed from the metal casing 401. For example, it can form by folding back from the external opening 402 to the inner side 318, by which the requirement of the development cost can be reduced. If the development cost permits, the resistant arm 512 can also be formed from an independent metal sheet. The internal conductive sheets 502, 503 are provided with at least one recession 511, wherein each recession 511 forms the resistant arm 512 from the rim, and the recession 511 includes a bending portion 513, a resistant contact 514 and a poke 515. The resistant contact 514 resists and clamps the relatively rear part of the counter connector (inner side of the tongue portion) in an up-down direction. The bending portion 513 is provided with a forming portion formed from the metal material yielded from the recession 511, and is connected to the resistant contact 514, and provided with a digging out 519 for easier formation. The resistant contact 514 is provided with the poke 515 corresponding to the cavity 516 on the internal conductive sheets 502, 503. When the resistant arm 512 is pressed, the cavity 516 is capable of containing the protruding portion 515. A positioning protrude 517 is configuring to install the internal conductive sheets 502, 503 with the insulative base 300.

Figure 5:
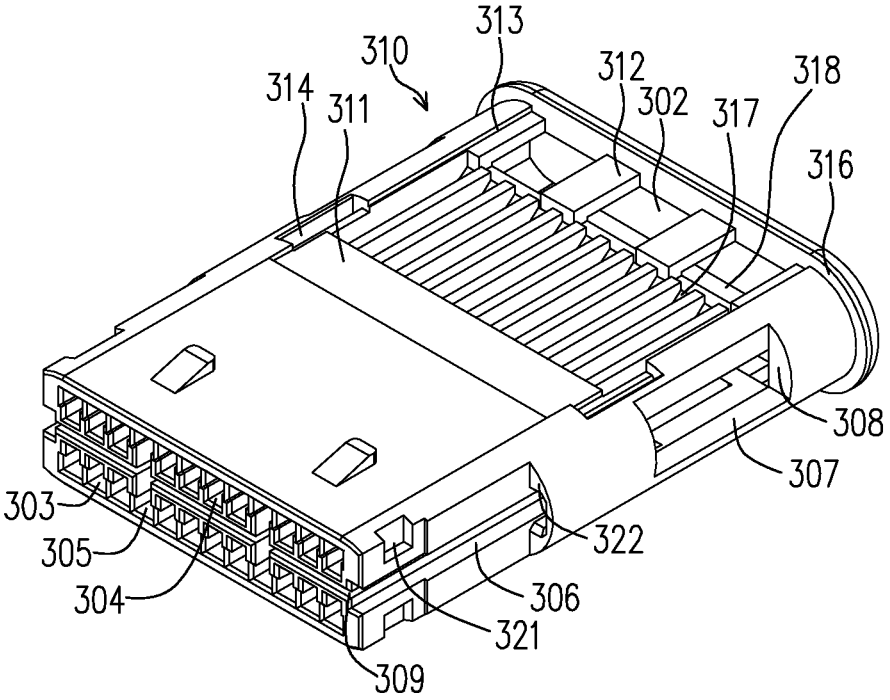
FIG. 5 is a perspective view of the insulative base of an electrical connector of the present invention.
Figure 6:
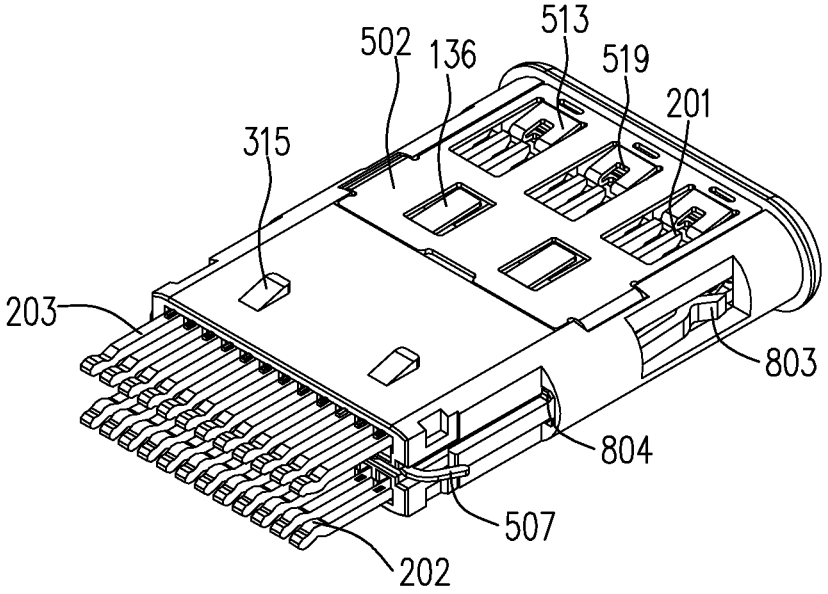
FIG. 6 is a perspective view of the insulative base of FIG. 5 when the insulative base is disposed with other components.

FIG. 5 and FIG. 6 describe the relationship between the external conductive sheet 501 and the insulative base 300 and the relationship between a pair of internal conductive sheets 502, 503 and the insulative base 300 in detail. Please also refer to FIG. 7 and FIG. 8, in which the external conductive sheet 501 is installed into the external conductive sheet slot 309 of the insulative base 300, wherein the external conductive sheet 501 is disposed between the first terminal groove 303 of the upper and lower rows. The internal conductive sheets 502, 503 are installed in the internal conductive sheet slot 310 of the insulative base 300. The internal conductive sheet slots 310 are disposed on the top surface and the bottom surface of the insulative base 300, each containing a internal conductive sheet. The internal conductive sheet slot 310 is provided with a columnar second holder 312 which is near the internal opening 302, and a planar first holder 311 which is at the other end (away from the internal opening 302). It can be seen that a step 313 is disposed in the internal conductive sheet slot 310. A positioning slot 314 is disposed on both side of the internal conductive sheet slot 310 for positioning with the positioning protrude 517.

Figure 3:
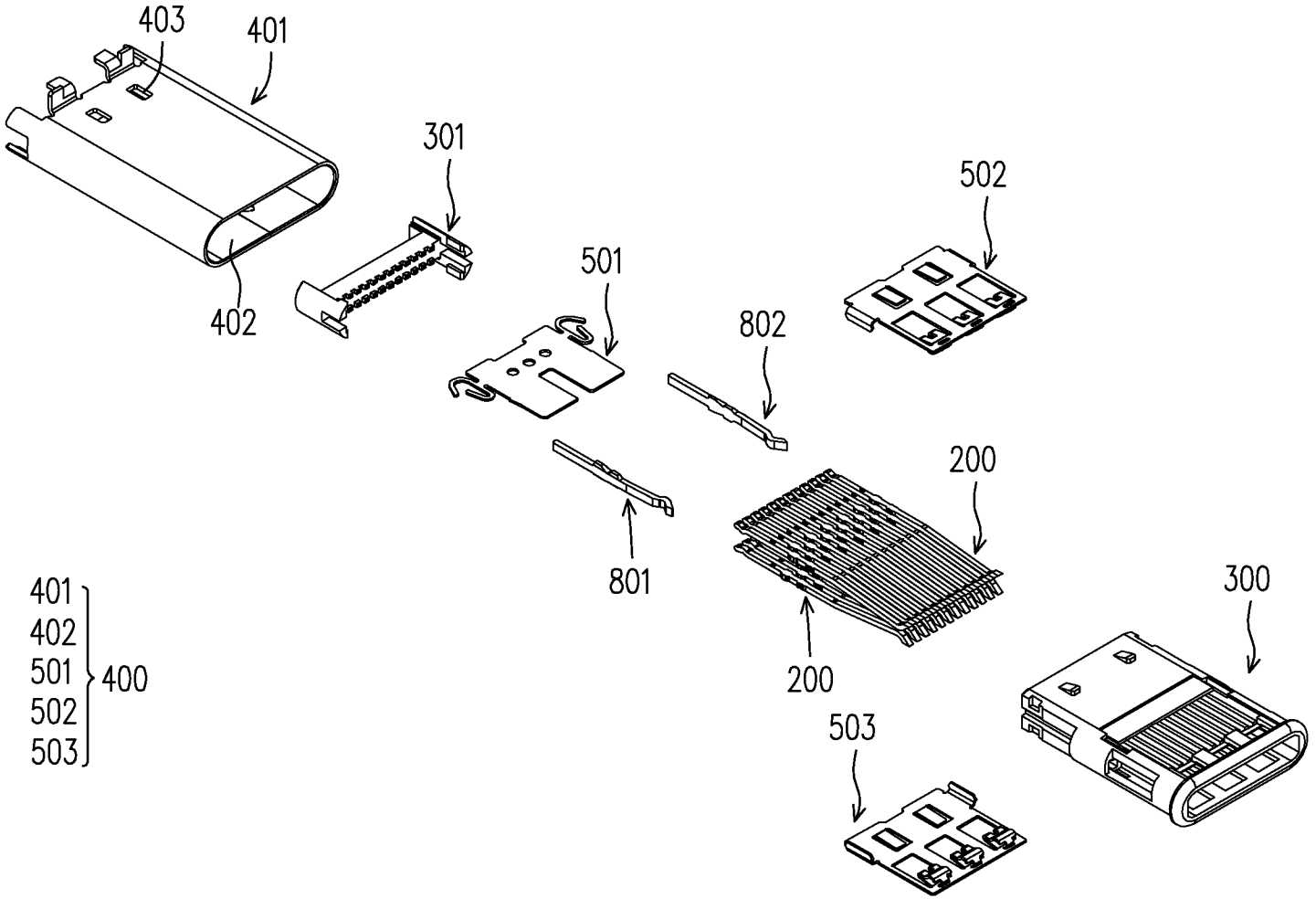
FIG. 3 is an exploded view of FIG. 2.
Figure 4:
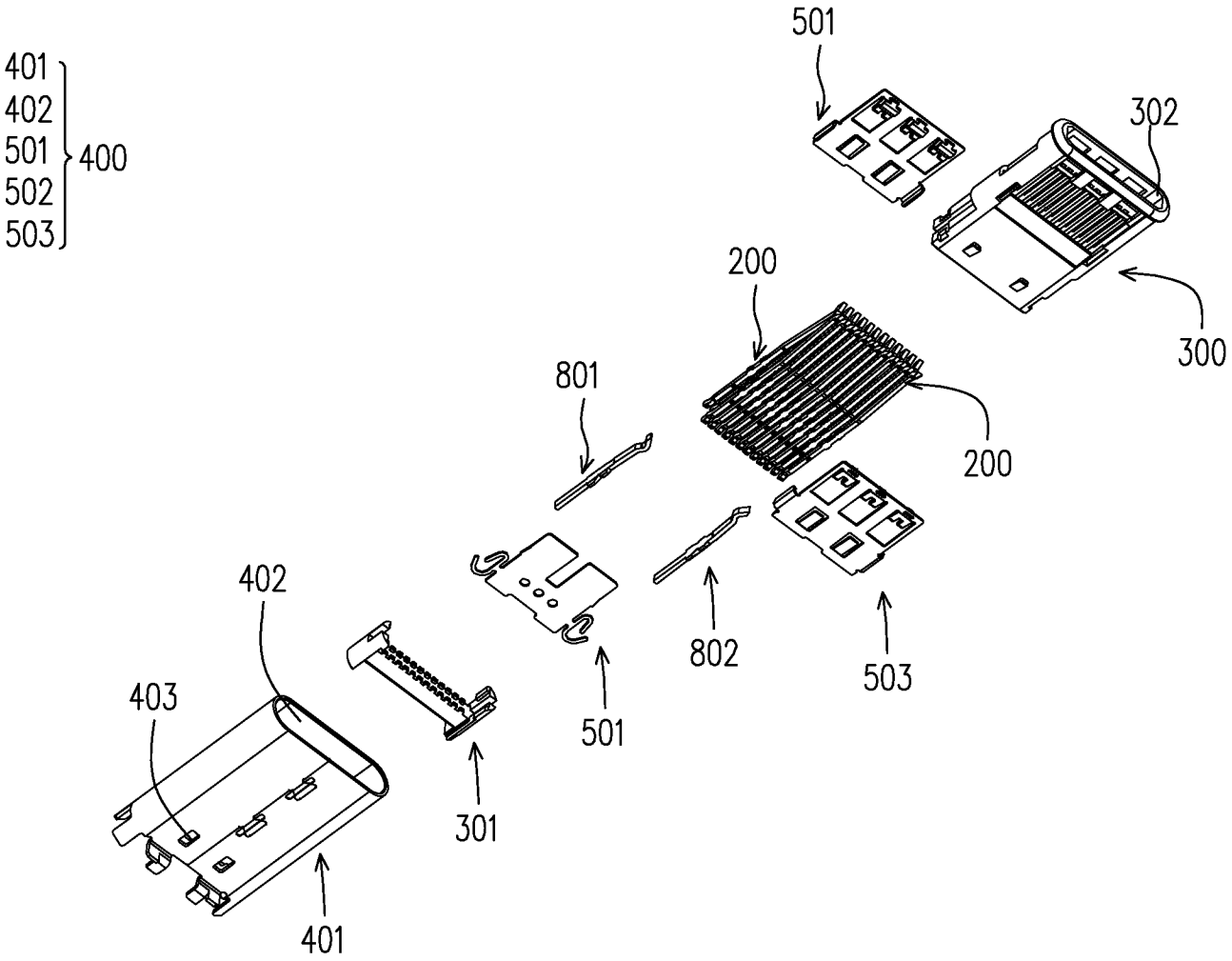
FIG. 4 is another exploded view of FIG. 3.

An insulative engagement 315 is disposed on the main body of the insulative base 300 for engaging with the casing engagement 403 of the metal casing 401 (FIG. 3). A perimeter 316 is disposed near the internal opening 302, wherein the perimeter is an extruding ring acting as a stopper to block the metal casing 401 in the installation (see FIG. 11). An inclining 317 is disposed on the first terminal groove 303 near the internal opening 302 for the oblique 204 of the contact portion 201 to lean against. In FIG. 5, the columnar first holder 311 of the hollowed out internal conductive sheet slot 310 can be seen through in such a manner that the inner side 318 of the insulative base 300 can be seen.

The rear base 301 of the insulative base 300 is provided with a hollow 319 for the second intruding end 507 to stretch out. The rear base 301 is provided with a convex 320 which engages with the concave 321 of the insulative base 300 for positioning (see FIG. 5).

Figure 9:
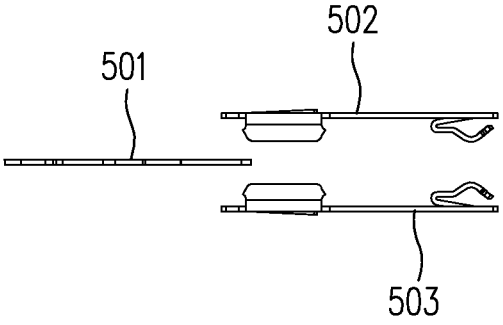
FIG. 9 is a side view of the external conductive sheet and a pair of internal conductive sheet of an electrical connector of the present invention.
Figure 10:
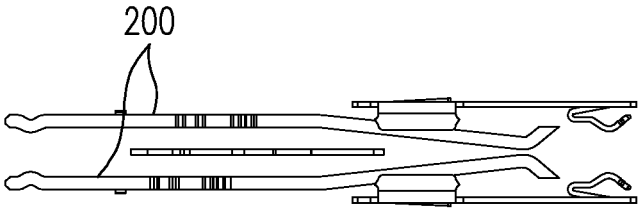
FIG. 10 is a side view of the components of FIG. 9 corresponding to the terminal set.
Figure 11:
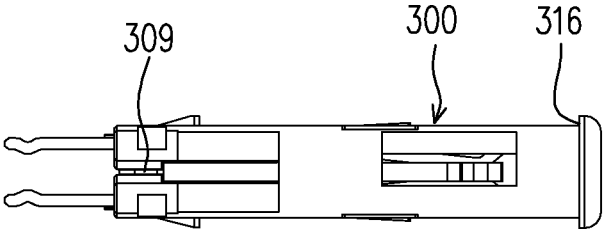
FIG. 11 is a side view of the disposition of the components of FIG. 10 and the insulative base.

FIG. 9 and FIG. 11 describe in detail the relationship between the external conductive sheet 501 and the insulative base 300 and the relationship between a pair of internal conductive sheets 502, 503 and the insulative base 300 from another view angle. The external conductive sheet 501 and a pair of metal inner leads 502, 503 are disposed in front-rear direction, wherein the external conductive sheet 501 is located between the pair of internal conductive sheets 502, 503. In FIG. 10 (please refer to FIG. 2), the external conductive sheet 501 is relatively close to the back end side 102, a pair of internal conductive sheets 502, 503 are relatively close to the front end plane 101, and the external conductive sheet 501 is disposed between the terminal set 200. After the insulative base 300 securely fixes the above components, it can be seen that the external conductive sheet slot 309 is located in a relative position in the middle of the terminal set 200. When the electrical connector 100 is in use, the external conductive sheet 501 and the pair of internal conductive sheets 502, 503 constitute a conducting state, achieving the shielding effect against the electromagnetic interference, especially for the terminal set 200 (the upper and lower contact portions 201, the upper and lower terminal bodies 203).

Figure 13:
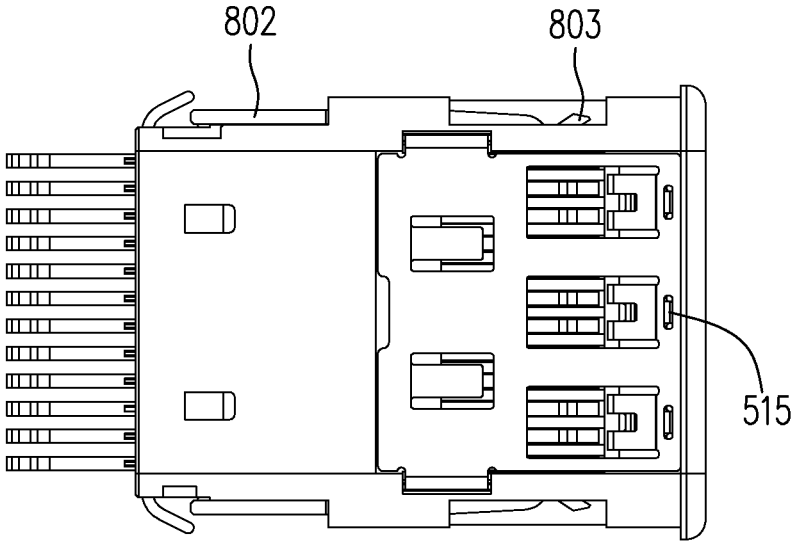
FIG. 13 is a top view of FIG. 11.

The first intruding end 506 of the conductive tail 504 of the external conductive sheet 501 are contacted with the tail portion of the resilient arms 801, 802, and the second intruding end 507 are contacted with the metal casing 401, and the outside ends of the pressing portions 803 of the resilient arm 801, 802 are contacted with the metal casing 401 (optionally). The conductive tongue 518 disposed on the internal conductive sheets 502, 503 are contacted with the metal casing 401. When the electrical connector 100 is in use, the external conductive sheet 501, the internal conductive sheets 502, 503 and the metal casing 401 constituted a conducting state, achieving the shielding effect against the electromagnetic interference (see FIG. 13).

As depicted in FIG. 16 to FIG. 19, according to another embodiment of the present invention, an electrical connector 100 comprises a first terminal set 200*a*, a second terminal set 200*c* and an external conductive sheet 501. The first terminal set 200*a* includes a plurality of first terminals 200*b* with the first connecting portions 202*a*, and a first subordinate base 331. The second terminal set 200*c* includes a plurality of second terminals 200*d* with the second connecting portions 202*b* and a second subordinate base 335, wherein the first subordinate base 331 is connected to the second subordinate base 335. The external conductive sheet 501 is disposed between the first subordinate base 331 and the second subordinate base 335, and extends to the space between part of the first terminals 200*b* and part of the second terminals 200*d*.

Line up the first terminals 200*b*, and utilize insert-molding manufacturing process to form the first terminal set 200*a*. Namely, inject a heated and melted insulating filling to the first connecting portion 202*a*. After the filling solidify, it forms the first subordinate base 331, and thus the first terminal 200*b* and the first subordinate base 331 are formed integrally. The same technical means can also be applied to make the second terminal 200*d* and the second subordinate base 335 formed integrally. There is no need to insert the first terminals 200*b* and the second terminals 200*d* one by one into the grooves. Besides, the integrally-formed first terminal set 200*a* and the integrally-formed second terminal set 200*c* are combined with each other tightly, which provides the first terminal set 200*a* and the second terminal set 200*c* with vibration-resistant ability. With the vibration-resistant ability, the electrical connector 100 is provided with better structural strength compared with prior art. The disposition of the external conductive sheet 501 can shield the first terminal set 200*a* and the second terminal set 200*c* from the crosstalk interference between the first terminal set 200*a* and the second terminal set 200*c*, and thus achieve good transmission effect.

Figure 17:
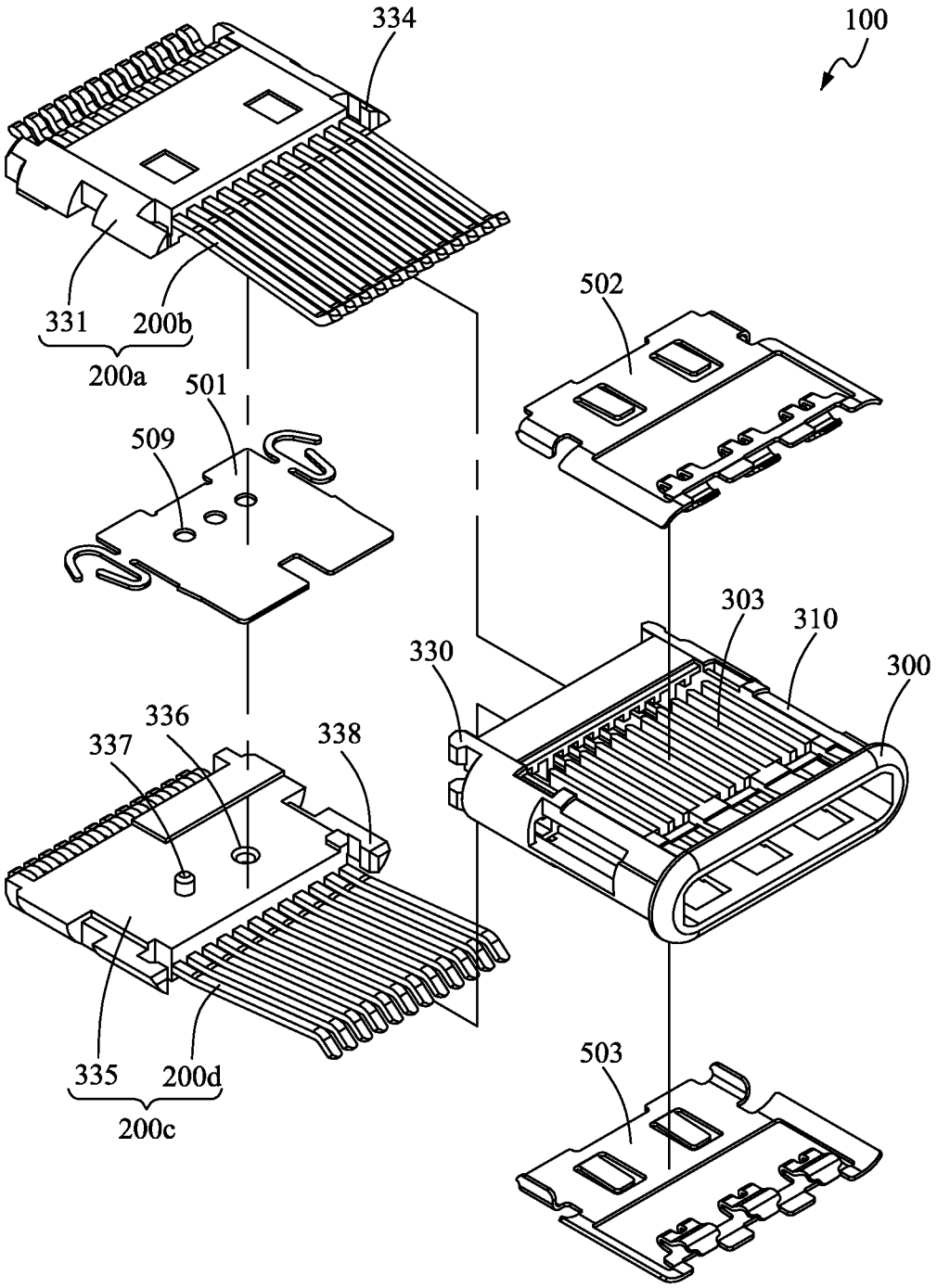
FIG. 17 is a perspective exploded view of FIG. 16.
Figure 19:
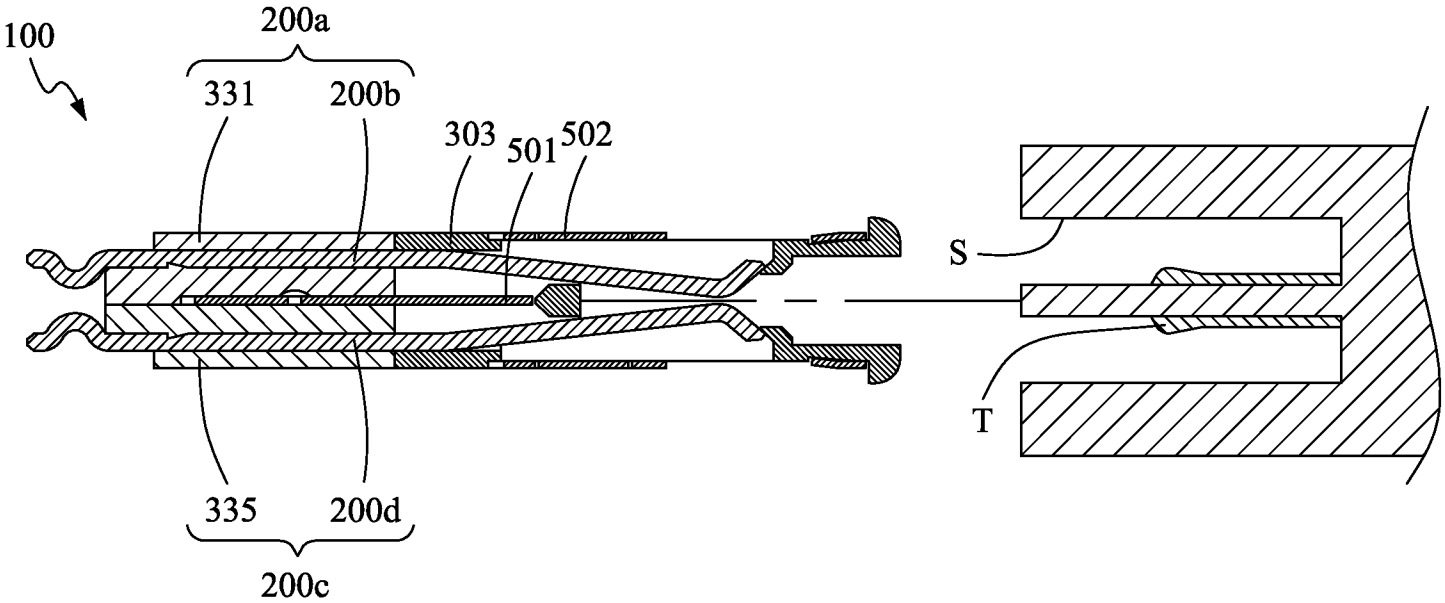
FIG. 19 is a sectional side view of the electrical connector of FIG. 16 and a counter connector.

As depicted in FIG. 17 and FIG. 19, according to the electrical connector 100 of the embodiment of the present invention, the first terminal 200*b* and the second terminal 200*d* are disposed in an upper row and a lower row. Each first terminal 200*b* is provided with a first contact portion 201*a*, and each second terminal 200*d* is provided with a second contact portion 201*b*, wherein the first contact portion 201*a* and the second contact portion 201*b* are disposed oppositely. The electrical connector 100 is connected with a matching counter connector S, wherein the corresponding terminals T inside the counter connector S are set up in an upper row and a lower row and in facing opposite directions respectively, by which the first contact portion 201*a* and the second contact portion 201*b* contact with the corresponding terminals T, which sends the transmission signal to a circuit board (not shown) via the first terminal 200*b* and the second terminal 200*d*.

Figure 18:
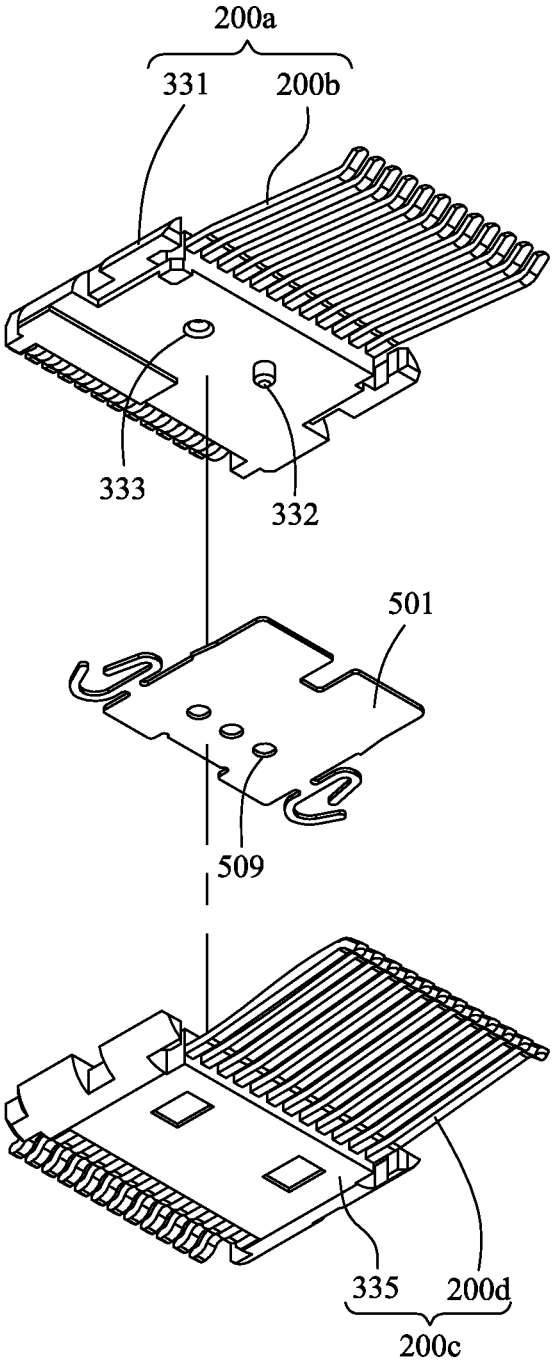
FIG. 18 is a perspective exploded view of FIG. 17 from another angle.

As illustrated in FIG. 17 and FIG. 18, according to the electrical connector 100 of the embodiment of the present invention, the first subordinate base 331 is provided with a First engagement 332 and a second engagement 333. The second subordinate base 335 is provided with a third engagement 336 and a fourth engagement 337. The first engagement 332 is connected to the third engagement 336, and the fourth 337 is connected to the second engagement 333, which make the first subordinate base 331 engage with the second subordinate base 335, and make the relative positions between each first terminal 200*b* and each second terminal 200*d* fixed. Certainly, the first subordinate base 331 and the second subordinate base 335 can also be connected by adhesion or buckling. The present invention is not limited to this.

As illustrated in FIG. 17 and FIG. 18, according to the electrical connector 100 of the embodiment of the present invention, the conductive tail 504 is provided with an aperture 509, which is provided for the first subordinate base 331 and the second subordinate base 335 to pierce through. The disposition of the aperture 509 make the external conductive sheet 501 firmly engaged between the first subordinate base 331 and the second subordinate base 335.

As illustrated in FIG. 17, according to the embodiment of the present invention, the electrical connector 100 further comprises a insulative base 300, which includes a plurality of terminal grooves 303, 305, wherein the terminal grooves 303, 305 are provided for containing the first terminal 200*b* and the second terminal 200*d*, and for maintaining a space between the first terminal 200*b* and the second terminal 200*d*. The insulative base 300 is made of insulating material. When the electrical connector 100 is connected with the counter connector S, the resilient first terminal 200*b* and the second terminal 200*d* touch the corresponding terminals T and bend. The disposition of the terminal grooves 303, 305 can prevent the curvature of the first terminal 200*b* and the second terminal 200*d*, and thereby prevent the effects of short circuit between the first terminal 200*b* and the second terminal 200*d*, which can occur when the terminals contact with each other.

As illustrated in FIG. 17, according to the electrical connector 100 of the embodiment of the present invention, the insulative base 300 includes a plurality of engaging notches 330, the first subordinate base 331 has a first engaging portion 334, and the second subordinate base 335 has a second engaging portion 338. The first engaging portion 334 and the second engaging portion 338 are engaged with the engaging notch 330, which enables the fixation of the relative position between the first terminal set 200*a* and the insulative base 300 and the fixation of the relative position between second terminal set 200*c* and the insulative base 300. Certainly, the first subordinate base 331 and the second subordinate base 335 can connect with the insulative base 300 by adhesion or lock-ups. Either way can achieve the effect of fixation. The present invention is not limited to this.

As illustrated in FIG. 17, according to the embodiment of the present invention, the electrical connector 100 further comprises a plurality of internal conductive sheets 502, 503 which are disposed on the outer surface of the insulative base 300. The internal conductive sheets 502, 503 shield the first terminal 200*b* and the second terminal 200*d* from part of external electromagnetic interferences. In the present embodiment, the top and the bottom of the first contact portion 201*a* and the second contact portion 201*b* respectively include an internal conductive sheet slot 310 on the outer surface of the insulative base 300. The internal conductive sheets 502, 503 are disposed in the internal conductive sheet slot 310, and thereby achieve good electromagnetic shielding effect at the first contact portion 201*a* and the second contact portion 201*b*.

While the invention has been described in terms of various specific embodiments, those skilled in the art will recognize that the invention can be practiced with modification within the spirit and scope of the claims.

What is claimed is:

1. An electrical connector, comprising:

a terminal set comprising a plurality of terminals arranged in parallel with each other;

an insulative base enclosing said terminal set comprising a plurality of terminal grooves;

an external conductive sheet slot is disposed between certain terminal grooves, defining an inner side of a hollow center in a mating direction;

a pair of resilient arms disposed within a trough ways configured on both sides of said insulative base; and a shielding assembly having a metal casing accommodating said insulative base, defining an external opening in above-mentioned mating direction, configuring at least one resistant arm adjacent to said external opening, and extended a resistant contact into said inner side;

an external conductive sheet received by said external conductive sheet slot, configuring a pair of resilient conductive tails both sides therein.

2. The electrical connector of claim 1, wherein said terminal set contains rows defined by an upper and a lower flat; each terminal including a contact portion and a connecting portion, said contact portion and said connecting portion respectively configured from a terminal body and extended to both ends of said terminal, wherein an oblique end is disposed on said contact portion.

3. The electrical connector of claim 2, wherein a resilient portion which is declined from said terminal body to the center reference point is configured between said terminal body and said contact portion of said terminal in said terminal set; said plurality of terminal grooves is provided for retaining the terminals and having a decline in the vertical direction; an inclining is disposed on said terminal groove corresponding to said oblique of said contact portion.

4. The electrical connector of claim 1, wherein said conductive tails of the external conductive sheet includes a first intruding end and a second intruding end which is extended from a ring body with bendings.

5. The electrical connector of claim 4, wherein said first intruding end is contacted with said resilient arm; said second intruding end is contacted with said metal casing.

6. The electrical connector of claim 1, wherein the internal conductive sheet slots are disposed on the top surface and the bottom surface of said insulative base; said shielding assembly further includes a pair of internal conductive sheets, said internal conductive sheet slot hold, at said resistant arm.

7. The electrical connector of claim 6, wherein said internal conductive sheet slot is provided with a ridge-like second holder adjacent to an internal opening of said insulative base and a planar first holder away from said internal opening, a step standing between said internal conductive sheet slot and said second holder.

8. The electrical connector of claim 6, wherein at least one recession is disposed on the internal conductive sheets, each recession forming said resistant arm along with one edge, and said resistant arm is provided with a bending portion extending said resistant contact.

9. The electrical connector of claim 8, wherein the end of said resistant contact is provided with a poke corresponding to a cavity poke disposed on said internal conductive sheet.

10. The electrical connector of claim 6, wherein the electrical connector is predetermined with a front end plane in the mating direction, a back end plane opposite to said front end plane, and a center body portion which is between said front end plane and said back end plane; said external conductive sheet and a pair of internal conductive sheets are given with an approximate front-rear placement, wherein said pair of internal conductive sheets adjacent to said front end plane; said external conductive sheet adjacent to said back end plane is located in the middle of said pair of internal conductive sheets, sandwiched between said terminal set.

11. The electrical connector of claim 1, wherein said insulative base comprising a main body, a first subordinate base and a second subordinate base, said first subordinate base preserves a first connecting portion of a first terminal set of said terminal set; said second subordinate base preserves a second connecting portion of a second terminal set of the said terminal set, wherein said first subordinate base is disposed on one side of said second subordinate base, said contact portion of said terminal set movably receiving in a part of said insulative base.

12. The electrical connector of claim 11, wherein said insulative base is provided with a plurality of engaging notches as a first engaging portion of said first subordinate base and a second engaging portion of said second subordinate base are respectively engaged to said engaging notches.

* * * * *